United States Patent [19]

Paul et al.

[11] Patent Number: 4,815,421

[45] Date of Patent: Mar. 28, 1989

[54] INTERNAL COMBUSTION ENGINE WITH ADJUSTABLE FLOW EXHAUST SYSTEM

[76] Inventors: Marius A. Paul; Ana Paul, both of 969 La Paz, Placentia, Calif. 92690

[21] Appl. No.: 51,494

[22] Filed: May 18, 1987

[51] Int. Cl.[4] ..... F02D 9/04; F01L 7/04

[52] U.S. Cl. ..... 123/65 PE; 123/65 VA

[58] Field of Search ..... 123/90.11, 65 VA, 188 B, 123/188 C, 65 PE

[56] References Cited

U.S. PATENT DOCUMENTS 2,573,301 10/1951 Berlyn ..... 123/65 VA
3,815,566 7/1974 Staggs ..... 123/65 VA
4,621,596 11/1986 Uchiniski ..... 123/65 PE
4,672,924 6/1987 Hiasa et al. ..... 123/65 PE
4,700,684 10/1987 Pischinger et al. ..... 123/90.11

*Primary Examiner*—Ira S. Lazarus
*Assistant Examiner*—Sue Hagarman
*Attorney, Agent, or Firm*—Bielen and Peterson

[57] ABSTRACT

A two-cycle internal combustion engine with electronically controlled fuel injection and electronically controlled exhaust flow, the exhaust flow being regulated by a displaceable slide valve which covers or exposes a plurality of exhaust ports around the top of the combustion chamber for optimizing exhaust flow in accordance with the actual operating conditions of the engine.

16 Claims, 2 Drawing Sheets

66
104
68
20
72
10
70
25
112
110
112
108
90
95
86
74
88
44
84
64
92
46
76
94
80
80
18
78
36
82
60
46
65
62
48
34
32
52
24
58
34
38
56
54
40
32
22
12
14
98

16
100
26
26
102
100
27
27
30
28
30

INTERNAL COMBUSTION ENGINE WITH ADJUSTABLE FLOW EXHAUST SYSTEM

BACKGROUND OF THE INVENTION

This invention relates to an internal combustion engine with fuel injection, and in particular, to an adjustable high volume exhaust valve for two-cycle engines. The adjustable high volume valve is particularly suitable for high speed short stroke engines in which fuel economy is maximized over a wide range of operating conditions.

The technology of engine design is currently focusing on air flow into and out of the cylinders as a primary avenue for maximizing power at the same time as minimizing fuel consumption. It has been discovered however, that certain air flow designs that maximize air flow into and out of the cylinders under peak performance conditions, fail to function properly under low speed conditions. For example, in certain advanced four and five valve, four-cycle, aspirated engines insufficient turbulence is generated to insure complete combustion during low operating speeds. In two-cycle engines, maximizing intake and exhaust conditions for peak performance will result in overscavenging at low speed conditions, resulting in not only a loss of fuel in spark ignited engines, but a waste of the charge and cooling of the exhaust flow in turbo-charged, autocombustion engines.

Furthermore, where adiabatic conditions are attempted to be maintained in the combustion chamber for autocombustion of injected fuel, an overscavenging can result in a substantial temperature loss to the combustion chamber resulting in incomplete or a total failure of combustion at low operating conditions.

In adapting the two-cycle diesel engine to automotive applications, the performance must match the current fuel efficient, high performance gasoline engines. While low rpm, long-stroke diesel work engines are particularly effective for a high load, constant speed, operating situation, rapid response at various speeds is conventionally lacking in such engines. The common two-stroke, high rpm, recreational engines having both intake and exhaust ports located in the cylinder wall exposed by the piston at the end of its power stroke, are unsuitable for automotive use because of antipollution requirements.

Advanced designs using multiple valves in the cylinder head with intake ports in the cylinder walls are comparatively effective in minimizing pollution and maximizing air flow. However, the total area even in four valve exhaust systems, approximates only 25% of the bore area of the cylinder. Furthermore, such multiple valve cylinder heads are not only enormously complex, high in cost, and low in reliability, but structurally form a weak head configuration that is limited in its capacity to support the high pressures and temperatures that make diesel or other autocombustion engines particularly desirable for maximum fuel efficiency.

Because most high performance engines must be designed for the variable operating conditions of the modern automobile for broad commercial success, the results are compromised designs which are neither optimized for high speed nor low speed conditions. The object of this invention is therefore to devise a design configuration for an internal combustion, fuel injected engine that has a variable air flow system that can be optimized for any operating conditions, and thus deliver an economical peak performance throughout the various speed and load conditions normally encountered by the modern, high-performance vehicle.

SUMMARY OF THE INVENTION

The fuel injected, internal combustion engine of this invention utilizes a cylinder design that focuses on optimizing the air or gas flow through the cylinder chamber under varying operating conditions. The advances in electronically controlled, fuel injection have enabled not only the quantity, but the timing and duration of the injection processed to be closely regulated. Various sensors throughout the engine can be monitored by a microprocessor to evaluate and control the fuel injection process. This freedom has enabled the design of advanced collateral systems for maximizing engines performance based on actual operating conditions. The subject invention utilizes such a conventional microprocessor design not only to control the fuel injection process, but also to control the air and gas flow through the cylinder by regulating the flow capacity of the exhaust ports.

In the cylinder design of this invention, a two-cycle, autocombustion engine, utilizes a cylinder having intake ports located proximate the head of the piston at the bottom of its stroke and, uniquely, cylinder wall exhaust ports located proximate the cylinder head at the top of its stroke. The unique cylinder wall exhaust ports at the top of the cylinder, open and close by hydraulic action on a displaceable cylinder sleeve. The cylinder sleeve reciprocates along the axis of the piston cylinder and is hydraulically controlled to either fully open or close or, open to any degree desired as actuated by the microprocessor. Not only is the timing of the opening and closing of the exhaust ports controllable, but the size of the the exhaust ports can be regulated according to actual operating conditions. In this manner not only the flow of exhaust from the combustion chamber, but the flow of air into the cylinder is regulated by the impedance of the exhaust process. Therefore, the intake and exhaust ports can be designed to maximize flows at peak operating conditions, yet by restriction of the size of the aperture to the exhaust ports, any interim condition can be optimized as well. In fact, with both the exhaust ports and the fuel injector under regulation, being regulated by the microprocessor, certain cylinders in a multi cylinder engine can be run with the exhaust ports maintained open and the fuel injection blocked for fuel conservation under light load, cruise conditions. These and other features will become apparent from a detailed description of the preferred embodiment hereinafter.

DETAILED DESCRIPTION OF THE PREFERRED EMBODIMENTS

Figure 1:
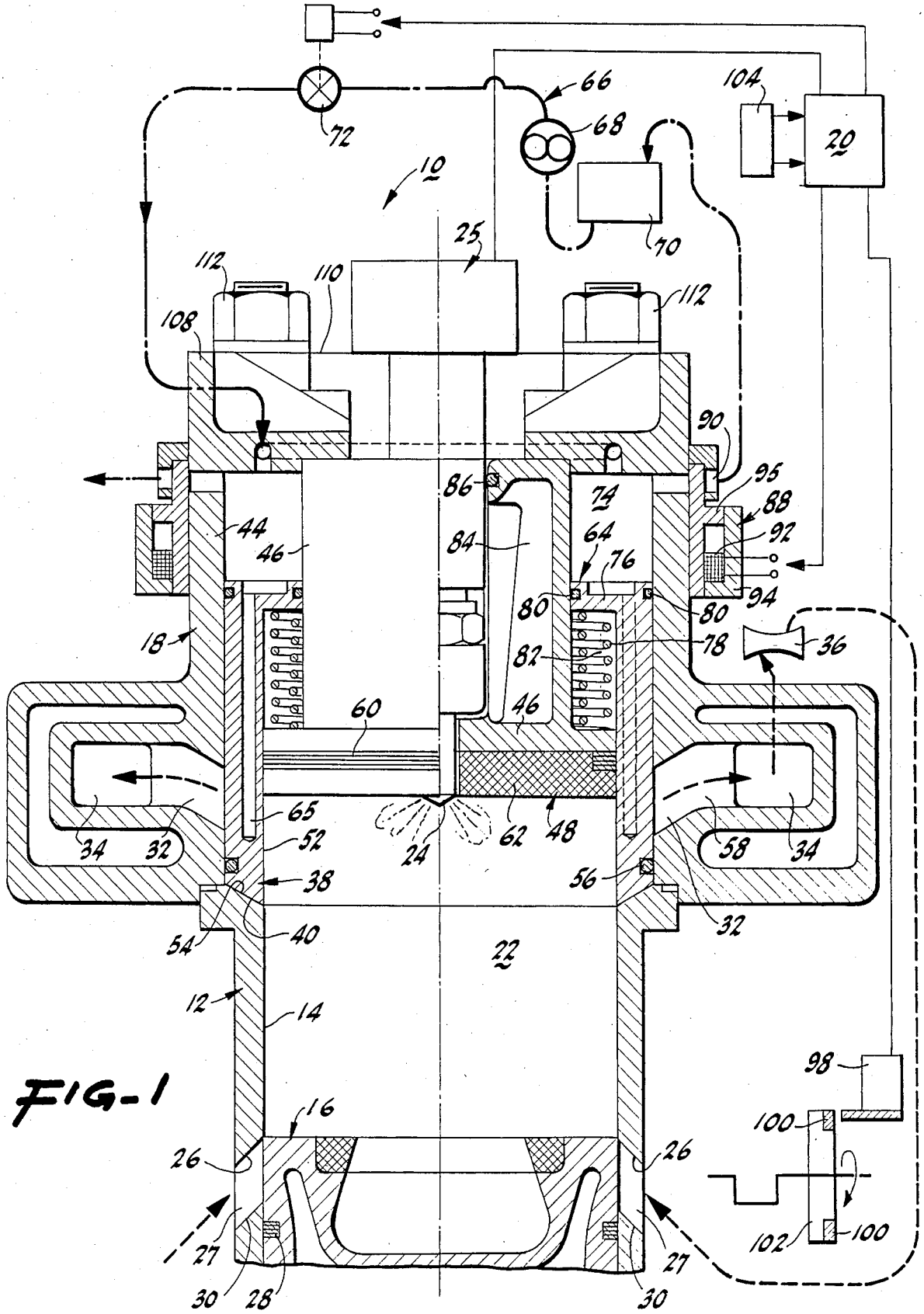
FIG. 1 is a cross sectional view of an engine partially fragmented, with a novel slide valve and control schematics.

Referring FIG. 1 an engine 10 shown in partial cross section, focusing on the combustion chamber, includes a block 12 forming a cylinder 14 in which a piston 16, shown in part, reciprocates. Capping the block 12 is a cylinder head assembly 18. The engine of FIG. 1 is a mono cylinder engine, however, it is to be understood that multiple cylinders can be arranged utilizing the novel cylinder head assembly to form a high power, multi cylinder engine. The cylinder head assembly 18 is connected to a microprocessor 20, shown schematically, which can be programmed for multiple cylinder operation. The block 12 and cylinder head assembly 18 form a combustion chamber 22 designed for high pressure, high temperature autocombustion of fuel which is injected through a fuel injection nozzle 24. In the exemplar embodiment of FIG. 1 the fuel is a diesel fuel and the engine is designed to be operated as a two-cycle diesel engine. However, it is to be understood that the other fuels can be utilized with minimal adjustment in the operating systems. The injection nozzle 24 of electronically operated fuel injector 25, is centrally positioned for optimum spray configuration, and, is electronically operated by the microporcesor in a conventional manner according to multiple input sensors.

In maximizing the efficiency of the two cycle operating engine, the intake and exhaust ports are located at opposite ends of the cylinder. In this manner scavenging is most effective and overscavenging is minimized. Furthermore, in locating the ports at opposite ends of the piston, the available area is doubled that of systems where both intake and exhaust ports are located in the same perimeter band around the cylinder wall proximate the head of the piston at the end of its stroke.

As shown in FIG. 1, intake ports 26 are located around the cylinder 14 and spaced by webs 27 providing structural integrity to the cylinder and a slide surface for the rings assembly 28 in the piston 16. Because no exhaust ports are interspaced between the intake ports 26, the effective area of the ports can be substantially increased. For example, in the embodiment FIG. 1 the approximate area of the intake ports in composite, equals the cross sectional area of the cylinder 14. The intake ports 26 are upwardly angled with the sides 30 of the webs 27 slanted from the radial to provide an upwardly spiraling swirl to the intake air as it enters the combustion chamber 22 and scavenges residual combustion gases from the cylinder.

In a similar fashion a plurality of exhaust ports 32 are peripherally arranged around the top of the combustion chamber 22 and communicate with a peripheral exhaust manifold 34 for delivering the exhaust gases to a discharge or preferably to an intermediate turbo charger 36 shown schematically.

The exhaust ports 32, however, do not have a clear passage to the combustion chamber 22. Between the exhaust combustion and the ports is a slide valve 38 that gates the exhaust ports 32. The slide valve 38 can be positioned in either the fully closed position shown in FIG. 1, in a position fully retracted such that the bevelled lower edge 40 of the slide valve 38 is flush with the top 42 of the exhaust ports 32 (not shown), or, selectively at any intermediate position therebetween.

The slide valve 38 is constructed in the form of a sleeve that reciprocates between the exhaust housing 44 and the support structure 46 for the fire deck 48 and the fuel injector 25. In the partially or fully advanced position of the slide valve 38 the cylindrical inner wall 52 of the slide valve forms a portion of the cylinder wall of the combustion chamber. To seal the exhaust ports 32 from the combustion chamber 32 during the compression and power stroke of the piston, the slide valve is provided not only with the bevelled edge 40 for seating with the top 54 of the cylinder block 12, but includes a sealing ring assembly 56 that engages a portion of the exhaust housing 44. In the same manner as the piston 16 and intake ports 26, the sealing ring assembly 56 for the side valve 38 slides over a series of structural webs 58 dividing the exhaust ports 32 in the exhaust housing 44. The slide valve 38 is sealed with respect to the fire deck 48 at the top of the combustion chamber 22 by a sealing ring assembly 60 located between the ceramic insulating shield 62 of the fire deck 48 and the metallic structural support 46 which retains the fuel injector 25 and slide valve assembly 64 in place. The valve includes sodium cooling chambers 65 spaced around its periphery.

Controlled reciprocation of the slide valve 38 is a accomplished by a hydraulic system 66 that includes an auxiliary oil pump 68 that draws oil from a reservoir 70 and passes the oil through an electronically operated shut-off valve 72 to an annular hydraulic drive chamber 74 in the cylinder head assembly 18. The hydraulic fuel or oil acts on an enlarged annular cap 76 to the slide valve 38 forcing the slide valve against the bias of a double spring assembly 78 when advancing the slide valve to close off the exhaust ports 32. The slide valve cap 76 has inner and outer o-rings 80 to prevent leakage of hydraulic fuel into the spring assembly chamber 82 or the exhaust ports 32. The spring assembly chamber 82 is bounded by the slide valve 38 and the fire deck support structure 46, which incidentally includes reinforcing webs 84 and o-rings 86 for seating and sealing the installed injector 25. The bias developed by the double spring assembly 78 returns the slide valve to the retracted position opening the exhaust when the oil pressure behind the slide valve cap 76 is relaxed.

Control of the oil flow is accomplished by an electronic bleed valve 88 which regulates the return orifice 90 from the hydraulic drive chamber 74 to the reservoir 90 as schematically shown in the drawing. It is of course understood that any electronically controlled, line valve may be utilized so long as the size of the return orifice can be regulated for select positioning of the slide valve under control of the microprocessor 20. The electromagnatic bleed valve 88 shown in FIG. 1 is annular in configuration with a core winding 92, a housing 94, a slide 95 and one or more return orifices 96. By varying the potential in the coil 92 the slide 95 can assume various positions under control of the microprocessor, thereby varying the position of the slide 95 over the orifices 90 and hence regulating the pressure of the hydraulic fluid in the hydraulic chamber 74. The pressure of the hydraulic fluid then determines the degree of displacement of the exhaust port slide valve 38 in accordance with the resistance of the spring assembly. The microprocessor output is regulated by an electronic timing system that senses the rpm from an rmp sensor 98 that detects spaced magnetic insets 100 in the flywheel 102, and a load sensor 104 for throttle position. Since the electronics are not a significant part of this invention they are shown only schematically and conventional electronic sensing and regulating means can be employed. It is understood that other sensors detecting engine temperature, torque and other important operating conditions are useful in monitoring engine performance, and, adjusting the fuel delivery and exhaust flow to meet those conditions. Of primary importance, herein, is the precise positioning of the exhaust port slide valve in accordance with the timing of the reciprocating piston, and the speed and load conditions under which the engine is performing. In this manner the position of the slide valve can be adjusted according to the actual conditions encountered by the engine.

For example, during high speed operation the slide valve will fully open the exhaust ports for rapid and complete exhaust and scavenging of the combustion gases. At slow speeds the valve will not fully open creating an impedance to the flow of scavenging gases such that the chamber is not overscavenged due to the comparatively large real time period encountered for the cycle segment of exhaust and admission.

The ability to exhaust large quantities of combustion in a short period of time through the enlarged exhaust ports enables the engine to operate at high pressures and combustion temperatures. The combustion chamber can then be lined in part with ceramic, for example a ceramic seal 62 at the fire deck 48 and a ceramic ring 105 around a precombustion chamber 106 formed in a recess in the power piston 16. The cylinder head assembly 18 is capped with a crown structure 108, fuel injector collar 110 and assembly bolts 112 for securing the components desired. While the engine shown is a monocylinder, it is understood that a plurality of such cylinders can be arranged in any conventional configuration for expanded power.

Figure 2:
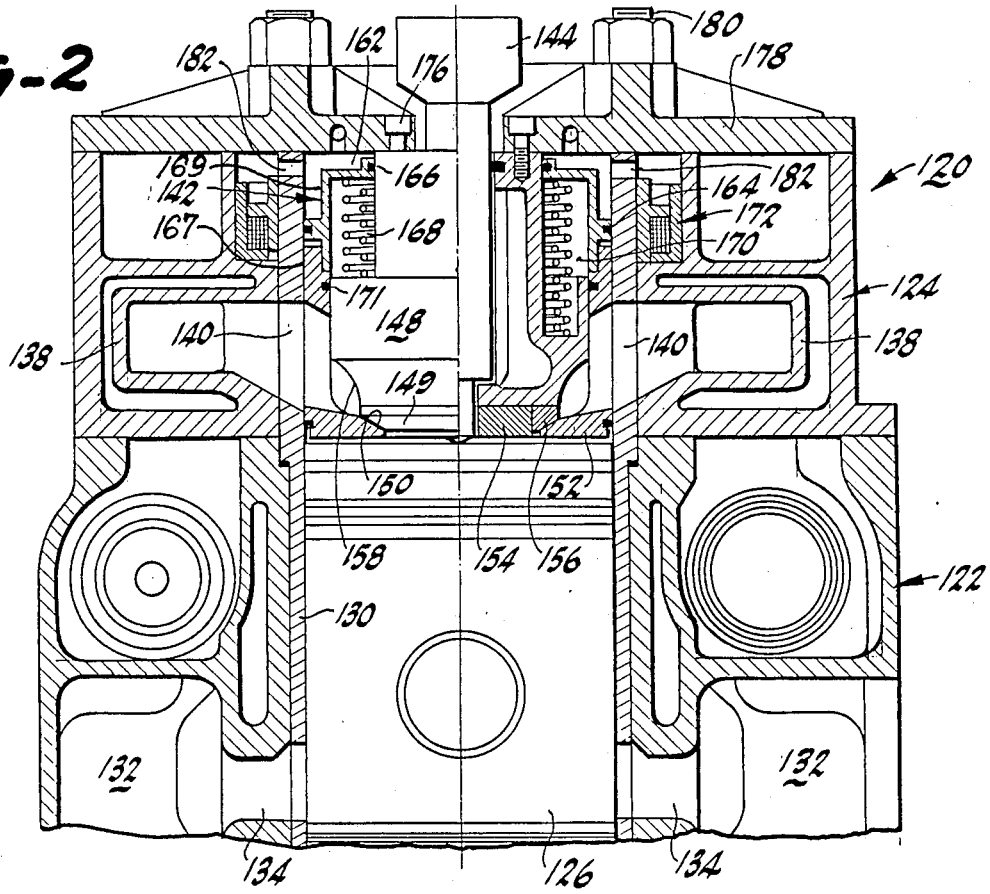
FIG. 2 is a cross sectional view of an alternate embodiment of an engine cylinder with a slide valve adapted to use the control system of FIG. 1.
Figure 3:
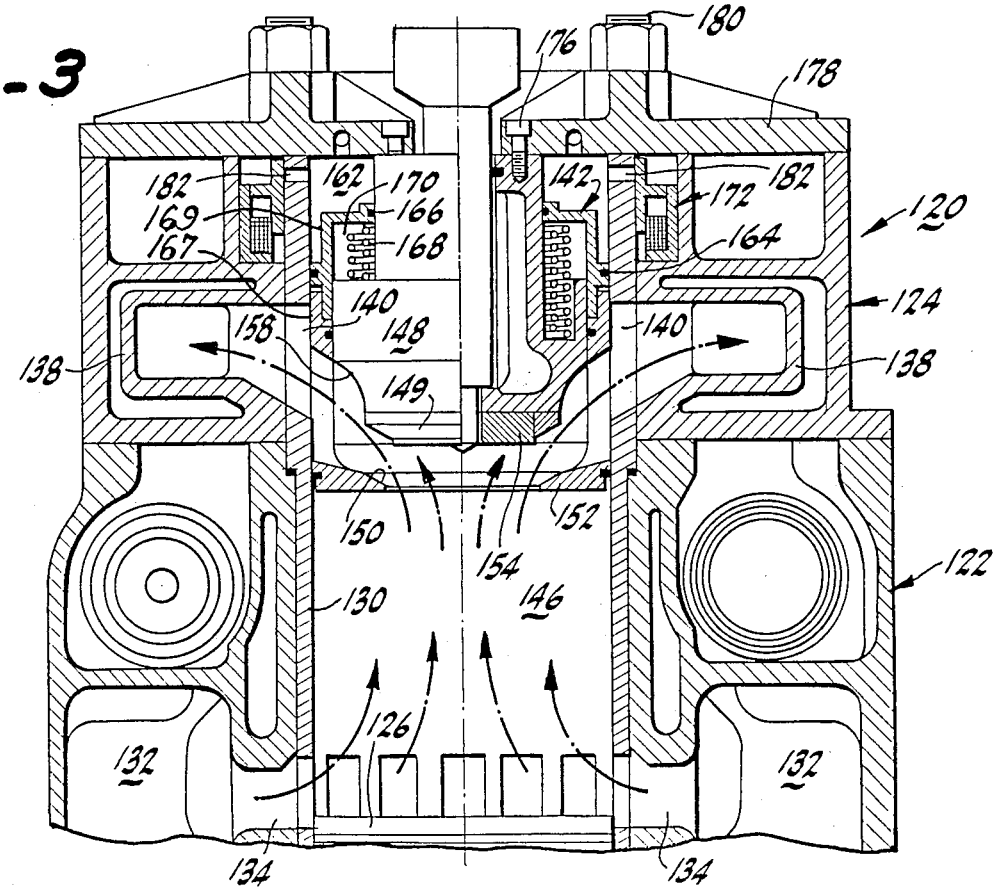
FIG. 3 is a view of the engine cylinder of FIG. 2 with the slide valve in an open position.

Referring now to FIGS. 2 and 3 of the drawings, an alternate engine embodiment 120 is shown with an engine block 122 and a cylinder head assembly 124. In the embodiment of FIGS. 2 and 3 the cylinder head construction is such that it can be adapted to a conventional engine block as shown, with only minor modifications. The engine blocks 122 includes a reciprocating piston 126, shown in part in FIGS. 2 and 3 and a cylinder 128 having a modified cylinder liner 130 to accommodate the cylinder head assembly 124. The engine block 122 is provided with an intake manifold 132 leading to a series of intake ports 134 located proximate the piston head 136 at the end of its power stroke.

The head assembly 124 includes an exhaust manifold structure 138 with exhaust ports 140 passing through an extension of the cylinder liner 130. As in the previously described embodiment, a hydraulically controlled slide valve 142 is displaceable with respect to the exhaust ports such that the effective aperture of the exhaust ports is varied according to operational criteria as monitored by a microprocessor. In the embodiment of FIGS. 2 and 3 the slide valve 142 has a slightly different configuration than that shown in FIG. 1. However, the operation is similar and relies conventional microprocessor 20 and hydraulic supply, as described in FIG. 1. In FIGS. 2 and 3, a centrally located fuel injector 144 is positioned over the combustion chamber 146 and supported by a support structure 148 that additionally provides a guide for the slide valve 142 and sealing seat 149 for a contact lip 150 on an annular shoe 152 at the end of the slide valve 142. The injector support structure includes a thermal protection liner 154 with an annular seat insert 156 and a contoured surface 158 to guide the flow of exhaust gases when the slide valve is advanced into the cylinder 150 during exhaust and scavenging of the combustion chamber 146 as shown in FIG. 3. As in the embodiment of FIG. 1, the slide valve 142 is hydraulically actuated by a hydraulic fluid in a hydraulic chamber 162 behind the slide valve 142. The slide valve 142 is sealed with respect to the cylinder liner 130 and the support structure 148 by o-rings 164 and ring seals 166 and 171. To adapt to the configuration of the support structure 148, the liner is constructed in two pieces with a sleeve 167 and a cap 169, and assembled over the support structure with a pair of compression springs 168 contained in a spring chamber 170 for return of the valve to its closed position. Although the bias of the spring and actuation of the hydraulic system are opposite that of the embodiment in FIG. 1, they are similarly controlled by an electronically controlled electromagnetic bleed valve 172 which is in turn controlled by signals from the microprocessor in a manner as disclosed with relation to the description of the embodiment in FIG. 1. The injector support structure 148 is fastened by machine screws 176 to a head assembly 178 which retains the exhaust manifold structure against the engine block by bolts 180.

As shown with respect to FIG. 2 when the piston is in the compression stroke the slide valve engages the inset seat and maintains the exhaust passages closed. After the piston has completed the power stroke the exit passages 182 from the hydraulic chamber 162 are closed and the hydraulic fluid pumped to the hydraulic chamber 162 forces the slide piston into its advance position as shown in FIG. 3. Because the slide valves are not cam operated the degree of displacement, timing and duration can all be controlled at the command of an electronic signal. This allows the operation of the slide valve to be programmed in accordance with the operating conditions of the engine in the same manner as is conventionally accomplished for electronic fuel injection systems. Because the sensors in microprocessors are conventional in nature they are shown only schematically in FIG. 1. It is to be understood that such systems are included in the structure of FIGS. 2 and 3.

Although a maximum exhaust flow in the embodiment of FIGS. 2 and 3 cannot quite match the flow of exhaust in the embodiment of FIG. 1, the flow nevertheless greatly exceeds that possible with conventional exhaust systems.

While the foregoing embodiment of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A two-cycle internal combustion engine comprising:

a cylinder with a cylinder wall and an end deck;

a piston with a piston head, the piston reciprocally moveable in the cylinder from a compression stroke position proximate the end deck and an expansion stroke position distal from the end deck, the piston head, end deck and wall of the cylinder between the head and end deck forming a combustion chamber with a top at the cylinder end deck;

intake means for introducing air into the cylinder at predetermined intervals, and, exhaust means for removing combustion gases from the cylinder at predetermined intervals wherein, the intake means includes a plurality of intake ports peripherally arranged in the wall of the cylinder proximate the piston head in the expansion stroke position and the exhaust means comprises a plurality of exhaust ports peripherally arranged in a cylindrical configuration proximate the top of the combustion chamber;

fuel injection means for injecting fuel into the cylinder at predetermined intervals;

slide valve means having a cylindrical sleeve juxtaposed to the exhaust ports;

actuating means for selective displacement of the sleeve between a position blocking the exhaust ports and a position exposing the exhaust ports at predetermined intervals;

sensing means for sensing engine performance conditions and producing a representative output signal; and, regulating means interconnecting the actuating means and the sensing means for regulating the actuating means to position the sleeve at a location between the position blocking the exhaust ports and fully exposing the exhaust ports in response to the representative output signal of the sensing means.

2. The engine of claim 1 wherein the regulating means comprises a hydraulic system and a spring assembly, the hydraulic system urging the slide valve means toward one of said two displacement positions and the spring assembly opposing said urging.

3. The engine of claim 2 wherein the hydraulic system includes a hydraulic fluid supply having hydraulic fluid in contact with the displaceable slide valve means and valve means for regulating the pressure of the hydraulic fluid wherein the position of the slide valve means is determined by the pressure of the hydraulic fluid in contact with the slide valve means.

4. The engine of claim 3 wherein the means for regulating the pressure of the hydraulic fluid comprises a hydraulic pump for pressurizing the fluid supply, an electronically controlled, electromagnetic bleed valve and a fluid reservoir for receiving hydraulic fluid bled through the bleed valve.

5. The engine of claim 4 wherein the hydraulic system is connected to a conventional microprocessor means for generating control signals for operating the fluid bleed valve in accordance with the position desired for the slide valve means.

6. The engine of claim 4 wherein the sensing means includes the microprocessor and a sensing system for monitoring engine performance conditions and generating a signal for optimum positioning of the slide valve means.

7. The engine of claim 6 wherein the fuel injector is an electronically controlled fuel injector connected to the microprocessor for generating control signals for operating the fuel injector in accordance with the timing, duration and fuel injection flow desired.

8. The engine of claim 7 wherein exhaust flow and fuel injection are both controlled by the microprocessor in accordance with sensed operating conditions of the engine.

9. The engine of claim 1 wherein the reciprocating slide valve means is displaceable in the same direction as the reciprocating piston.

10. The engine of claim 9 wherein the fuel injector is centrally located in the cylinder and has a nozzle directing a fuel spray into the combustion chamber.

11. The engine of claim 10 wherein the slide valve in the position locking the exhaust ports forms a portion of the combustion chamber.

12. The engine of claim 11 having an exhaust manifold structure around the top of the combustion chamber with exhaust ports selectively communicating with the combustion chamber, the slide valve means being positioned between the manifold structure and the end deck of the cylinder.

13. The engine of claim 12 wherein the sleeve of the slide valve means includes a ring assembly slidably engaging the manifold structure and the end deck includes a ring assembly slidably engaged by the sleeve.

14. The engine of claim 2 wherein the slide valve means has an annular cap connected to the sleeve, the cap being engaged on one side by the hydraulic system and engaged on the other side by the spring assembly.

15. The engine of claim 2 wherein the cylinder has a cylindrical extension portion above the combustion chamber with the exhaust ports peripherally arranged therein, and the end deck has an annular passage between the end deck and the extension portion with a sealing seat, the valve sleeve having an end with an annular shoe portion engageable with the end deck, and apertures through the sleeve coincident with the exhaust ports wherein on advance of the slide valve means into the combustion chamber an annular passage is formed to the exhaust ports, and on retraction of the slide valve means the passage is blocked.

16. The engine of claim 15 having further a support structure for the end deck and fuel injection means, wherein the slide valve means is constructed in a two-piece assembly for installation around the support structure.

* * * * *